US007278627B2

(12) United States Patent
Jones

(10) Patent No.: US 7,278,627 B2
(45) Date of Patent: Oct. 9, 2007

(54) RIDING LAWN MOWER LIFT

(76) Inventor: Raymond A. Jones, P.O. Box 96, Belton, MO (US) 64012

( * ) Notice: Subject to any disclaimer, the term of this patent is extended or adjusted under 35 U.S.C. 154(b) by 142 days.

(21) Appl. No.: 11/112,462

(22) Filed: Apr. 22, 2005

(65) Prior Publication Data

US 2005/0253122 A1 Nov. 17, 2005

Related U.S. Application Data

(60) Provisional application No. 60/564,787, filed on Apr. 23, 2004.

(51) Int. Cl.
*B66F 7/00* (2006.01)
*E02C 3/00* (2006.01)

(52) U.S. Cl. ..... 254/88; 254/94

(58) Field of Classification Search ..... 254/1, 254/88, 89 R, 91, 94, DIG. 4
See application file for complete search history.

(56) References Cited

U.S. PATENT DOCUMENTS 1,271,584 A 7/1918 Klemme
1,510,209 A 9/1924 Christman
4,088,303 A * 5/1978 Aquila ..... 254/88
4,113,235 A 9/1978 Hartman, Jr.
4,120,485 A 10/1978 McConnell
4,549,721 A * 10/1985 Stone ..... 254/126
4,958,804 A 9/1990 Lenius et al.
5,000,423 A 3/1991 Snickers
6,135,420 A * 10/2000 Johnston et al. ..... 254/88
6,206,346 B1 * 3/2001 Johnson et al. ..... 254/88
6,330,997 B2 * 12/2001 McGlaun et al. ..... 254/94
6,345,807 B1 * 2/2002 Cacciatore ..... 254/3 B
6,464,204 B1 * 10/2002 Johnson et al. ..... 254/88
6,948,724 B2 * 9/2005 Davis ..... 280/30
2004/0251661 A1 * 12/2004 Davis ..... 280/656

* cited by examiner

*Primary Examiner*—David B Thomas
(74) *Attorney, Agent, or Firm*—Chase Law Firm, L.C.

(57) ABSTRACT

A lift and support structure is provided for a lawn tractor which includes a frame with a center lift member secured to and separating a pair of wheel support members. Ramps are secured to the wheel support members to permit the front or rear wheels of the lawn tractor to be rolled onto or off of the lift and support structure. The center lift member is elevated above the wheel support members to permit a floor jack or other lifting mechanisms to be placed under the lift and support structure. A pair of support legs may be locked in a raised position to support the lawn tractor for safe and easy access to the underneath side of the tractor, and may be pivoted or folded to the side when the lift and support structure is in a lowered position.

14 Claims, 3 Drawing Sheets

RIDING LAWN MOWER LIFT

CROSS-REFERENCE TO RELATED APPLICATION

This application claims the benefit of a prior filed, now abandoned application Ser. No. 60/564,787, filed Apr. 23, 2004, entitled RIDING LAWN MOWER LIFT.

FIELD OF THE INVENTION

The present invention relates to lifts and supports for lawn and garden tractors and, more particularly, to a structure for use in combination with a floor jack to lift the front wheels of a lawn or garden tractor and support the tractor in the raised position to allow safe access to the area under the mower deck.

BACKGROUND OF THE INVENTION

Lawn and garden tractors are commonly used to mow grass. The lawn tractor has a mower deck which houses one or more mower blades. The area between the mower deck and blades often becomes caked with grass clippings, especially if the grass is mowed when the grass is wet. The grass clippings often form layers which harden as the mower is used. Eventually, the layers accumulate and consume the entire space between the mower deck and the blades. Without this space, the mower becomes inefficient and eventually may quit cutting the grass entirely. Additionally, this debris can damage the blades and strain the belts, engine and bearings.

The typical lawn tractor has a clearance of one inch to four inches between the lower periphery of the mower deck and the ground. This small clearance makes it difficult to clean the area under the mower deck. The width of the mower deck provides additional challenges to reach all of the areas under the mower deck.

The blades also require at least yearly sharpening which entails removing the blades, sharpening them, then reinstalling them. Periodically, the blades also need to be replaced.

To perform this cleaning and periodic maintenance, the user must have access to the area under the mower deck, or take the mower to a repair shop which has the equipment to lift the mower. Because a typical lawn tractor weights 500 pounds to 1200 pounds or more, it is difficult to turn the lawn tractor on its side, especially for an individual, to access the area under the mower deck. An individual may attempt to raise the lawn tractor and support with a jack or jack stands. However, this often results in a situation in which the lawn tractor is inadequately supported, unstable and potentially dangerous or unsafe.

SUMMARY OF THE INVENTION

The present invention presents an apparatus to aid in lifting and supporting the front end of a lawn tractor to allow a safe and relatively easy access to the area under the mower deck. The lifting and support apparatus includes a frame with a pair of spaced-apart ramps, a center lift structure and a pair of support legs which pivot between a lowered position and a locked lifted or raised position. The front wheels of the lawn tractor to be lifted are driven up the ramps secured to the frame and onto the frame. The lifting arm of a floor jack is then centered under the center lift structure. The jack may then be extended to lift the front end of the lawn tractor. Once the front end is raised, the support legs may be pivoted to the raised support position and locked in place with locking pins or spring locking pins. The area under the lawn tractor may now be safely accessed for cleaning, sharpening the blades, or general maintenance. Once the task is completed, the legs may be unlocked and pivoted back to the lowered position, and the jack lowered to lower the front end of the lawn tractor. The lawn tractor may then be driven off the ramps.

BRIEF DESCRIPTION OF THE DRAWINGS

FIG. 7 is a perspective view of another embodiment of the lift and support structure.

DETAILED DESCRIPTION

Figure 1:
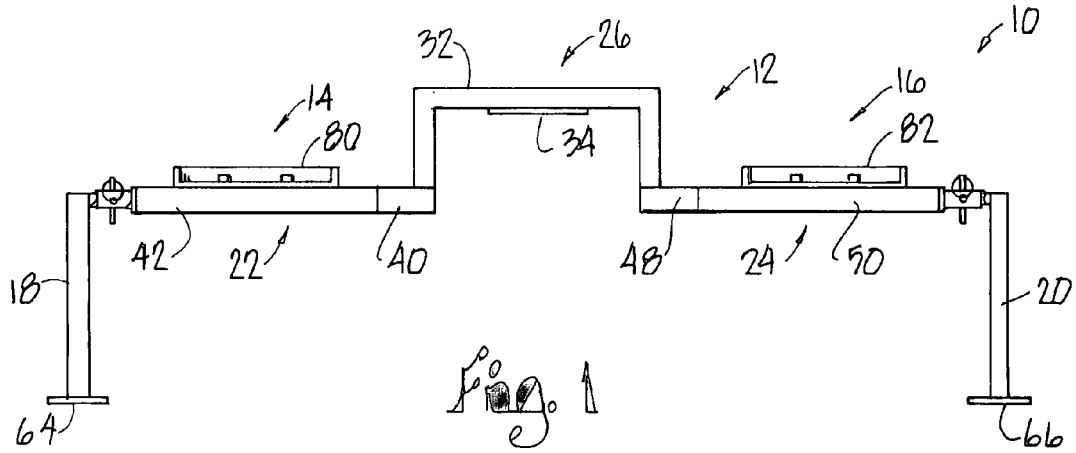
FIG. 1 is a front elevational view of the lifting and support structure of the present invention shown in the raised position.
Figure 2:
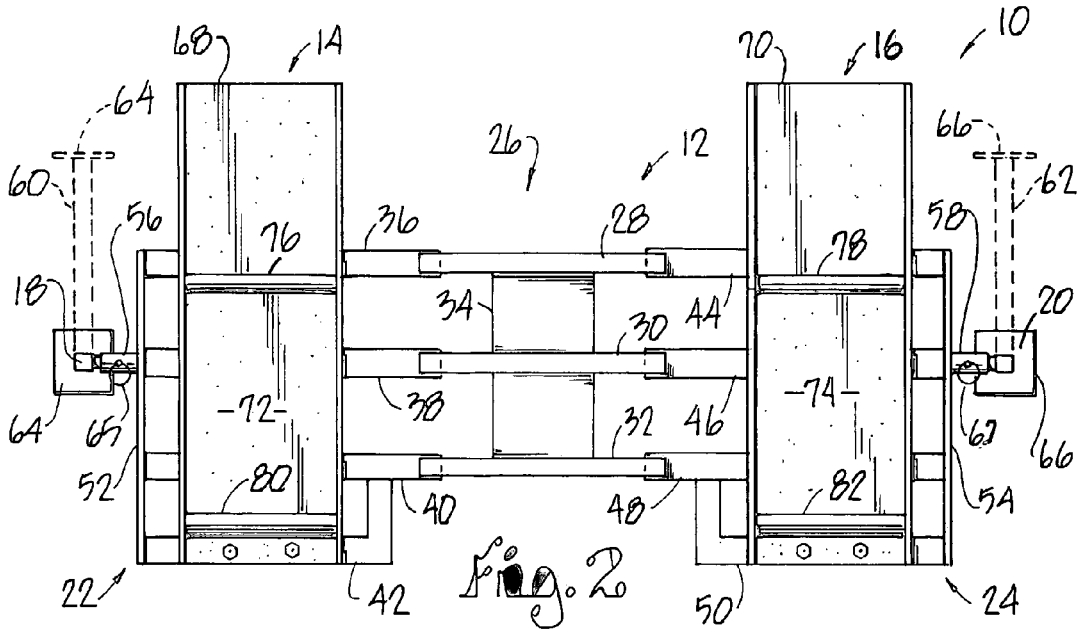
FIG. 2 is a top plan view of the lifting and support structure of FIG. 1.

Referring to FIGS. 1-4 the lifting and support structure of the present invention is generally indicated by reference numeral 10. Lifting and support structure 10 includes a frame 12, ramps 14 and 16, and support legs 18 and 20. Frame 12 includes wheel support frames 22 and 24 and a center lift frame 26. Center lift frame includes three generally C-shaped cross members 28, 30 and 32 which are secured together by a lift pad 34. Opposite ends of the C-shaped cross members 28, 30 and 32 are secured to the cross members of the wheel support frames 22 and 24.

Support frames 22 and 24 include cross members 36, 36, 40 and 42, and 44, 46, 48 and 50, respectively. At one end, cross members 36, 38 and 40 are secured to one end of C-shaped cross members 28, 30, and 32, respectively, and at the other ends are secured together with an end plate 52. Cross member 42 is generally C-shaped and is secured to the cross member 40 at one end and to the end plate 52 at the opposite end.

Support frames 22 and 24 may be constructed of two-inch square steel tubing welded or otherwise secured to end plates 52 and 54 at one end, respectively. End plates 52 and 54 may be quarter-inch steel plates. At the other end, the cross members are welded or otherwise secured to the ends of center lift frame 26.

Center lift frame 26 may be constructed of one and one-half to two inch square steel tubing which is welded together to form the general C-shape of the center lift frame 26. Lift pad 34 may be a quarter-inch steel plate welded to each of the cross members 28, 30 and 32 of center lift frame 26.

A pair of leg supports 56 and 58 extend from end plates 52 and 54, respectively. Leg supports 56 and 58 may be three-quarters to one inch round steel tubing which may extend through the end plates 52 and 54, respectively, into cross members 38 and 46, respectively, to provide additional support for the support legs 18 and 20 and frame 12.

Figure 3:
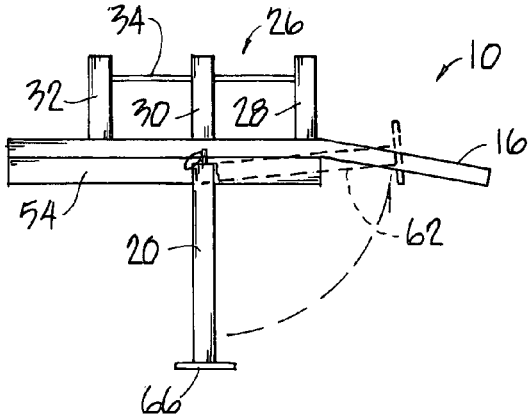
FIG. 3 is a right end view of the lifting and support structure of FIG. 1.

Support legs 18 and 20 each are generally an inverted L-shape. The horizontal portion of the L-shape is inserted into the leg supports 56 and 58 and may be pivoted between a lowered position generally indicated by reference numerals 60 and 62 (see FIG. 2) and a raised position (as shown in FIGS. 1 and 3). Each support leg 18 and 20 includes a foot or stabilization pad 64 and 66, respectively, and are held in place with locking pins 65 and 67, respectively.

Ramps 14 and 16 are fastened or bolted to the cross members 42 and 50, respectively, and may be adjustable inwardly or outwardly to match the width of the front wheels of different lawn tractors. Ramps 14 and 16 each include an inclined portion 68 and 70, a level portion 72 and 74, and front 76 and 78 and rear 80 and 82 stops, respectively.

Figure 5:
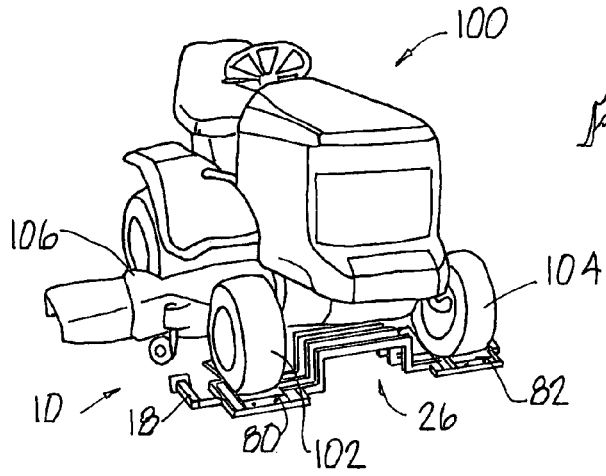
FIG. 5 is a perspective view of the lifting and support structure shown in the lowered position with a lawn tractor driven onto the frame.
Figure 6:
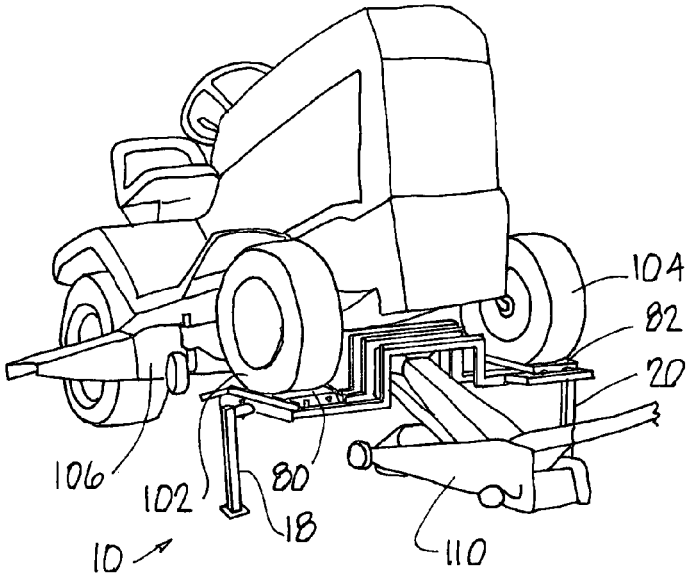
FIG. 6 is a perspective view of the lifting and support structure shown in the raised position with the front wheels of the lawn tractor raised and supported on the frame.
Figure 4:
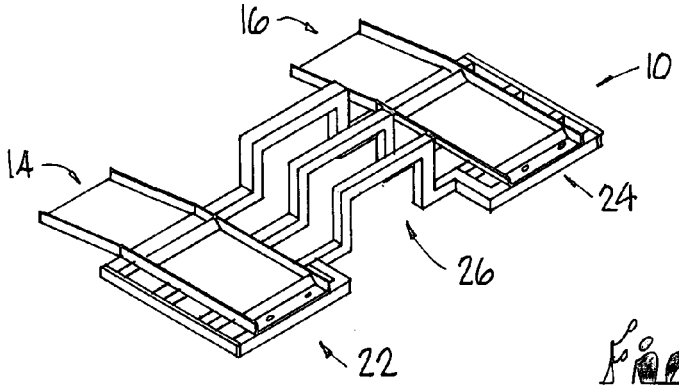
FIG. 4 is a perspective view of the lifting and support structure of FIG. 1.
Figure 1:
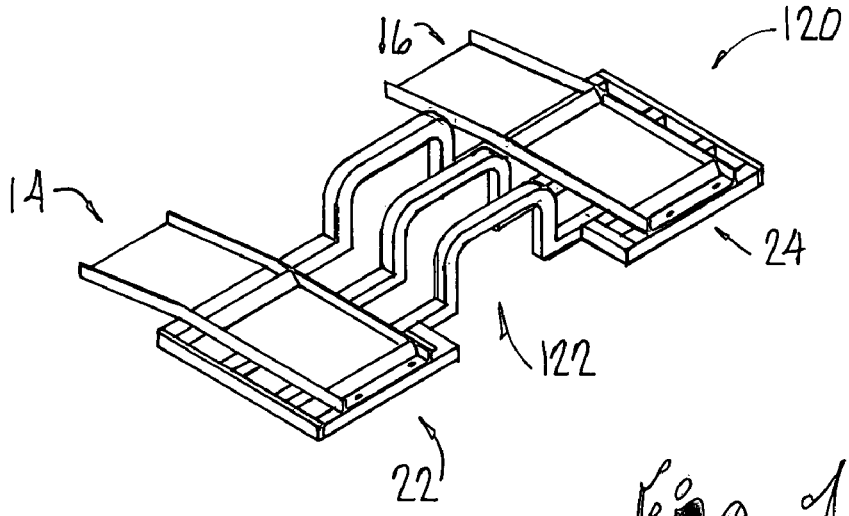

Referring to FIGS. 5 and 6, a lawn tractor 100 is driven up the ramps 14 and 16 over rear stops 76 and 78, until the front wheels 102 and 104 come to rest against the front stops 80 and 82, respectively. The rear stops 76 and 78 (not shown) prevent the lawn tractor 100 from rolling backward.

A floor jack 110 may be placed under the center lift frame 26 and lift pad 34 to lift the front end of the lawn tractor 100. Once the front end is raised 12-18 inches or more, the support legs 18 and 20 may be pivoted into the raised position and secured by locking pins 65 and 67 (not shown). The jack 110 may be lowered so that the weight of the lawn tractor 110 rests on the support legs 18 and 20. The area under the mower deck 106 may now be safely accessed.

Once the maintenance is completed, the floor jack 110 may be used to lift the weight of the lawn tractor 100 off of support legs 18 and 20, which are then folded to the lowered position and the front end of the lawn tractor is lowered. The lawn tractor 100 may now be driven off of the lift and support structure 10.

Referring to FIG. 7, an alternate embodiment of the lift and support structure is generally indicated by reference numeral 120. The components of the lift and support structure 120 are generally the same as the lift and support structure 10 shown in FIGS. 1-6 with the exception of the center lift frame 122. Instead of square tubing that is cut and welded together with miter or butt joints for center lift frame 26 as shown in FIG. 1, the square tubing is bent to form rounded corners. The center lift frame 122 with rounded corners has an advantage over the center lift frame 26 of fewer assembly operations.

It is to be understood that while certain forms of this invention have been illustrated and described, it is not limited thereto, except in so far as such limitations are included in the following claims and allowable equivalents thereof.

The invention claimed is:

1. A lifting and support structure for a lawn tractor comprising:

a frame having a pair of opposed wheel support members separated by an elevated center lift member;

a lift pad secured to a bottom surface of said center lift member;

a pair of ramps secured to said wheel support members;

a pair of support legs pivotally connected to said wheel support members;

a pair of front stops secured to a front portion of each of said ramps; and a pair of rear stops secured to a rear portion of each of said ramps;

said support legs selectively pivotal between a lowered position to permit the lawn tractor to be rolled onto or off of said ramps, and a raised position to support the lawn tractor in an elevated position.

2. The lifting and support structure as set forth in claim 1 wherein said center lift member includes at least two generally C-shaped cross members.

3. The lifting and support structure as set forth in claim 2 wherein said wheel support members each include cross members fastened to said cross members of said center lift member.

4. The lifting and support structure as set forth in claim 1 further comprising a pair of end plates each secured to an outer end of said wheel support members.

5. The lifting and support structure as set forth in claim 4 wherein each of said support legs are secured to one of said end plates.

6. The lifting and support structure as set forth in claim 1 wherein each of said support legs includes a stabilization pad.

7. The lifting and support structure as set forth in claim 1 further comprising a pair of locking pins and an aperture in each of said support legs, said apertures adapted to receive said locking pins to lock said support legs in said raised position.

8. The lifting and support structure as set forth in claim 1 wherein each of said ramps include an inclined portion and a level portion.

9. The lifting and support structure as set forth in claim 8 wherein said level portion of said ramps is secured to said wheel support members.

10. The lifting and support structure as set forth in claim 8 wherein said front stops and said rear stops is secured to said level portion of said ramps.

11. A lifting and support structure for a lawn tractor comprising:

a frame having a pair of opposed wheel support members and a center lift member;

a lift pad secured to a bottom side of said center lift member;

a pair of ramps secured to said wheel support members; and a pair of support legs pivotally connected to said wheel support members;

said support legs selectively pivotal between a lowered position to permit the lawn tractor to be rolled onto or off of said ramps, and a raised position to support the lawn tractor in an elevated position;

wherein said center lift member is elevated relative to said wheel support members.

12. The lifting and support structure as set forth in claim 11 further comprising a pair of front stops secured to a front portion of each of said ramps to impede forward movement of the lawn tractor beyond said front stops.

13. The lifting and support structure as set forth in claim 11 further comprising a pair of rear stops secured to a rear portion of each of said ramps to impede rearward movement of the lawn tractor beyond said rear stops.

14. A lifting and support structure for a lawn tractor comprising:

a frame having a pair of opposed wheel support members and a center lift member;

a lift pad secured to a bottom side of said center lift member;

a pair of ramps secured to said wheel support members;

a pair of support legs pivotally connected to said wheel support members;

a pair of front stops secured to a front portion of each of said ramps; and a pair of rear stops secured to a rear portion of each of said ramps;

said support legs selectively pivotal between a lowered position to permit the lawn tractor to be rolled onto or off of said ramps, and a raised position to support the lawn tractor in an elevated position;

wherein said center lift member is elevated relative to said wheel support members.

* * * * *